United States Patent [19]

Blakeway

[11] 4,370,839

[45] Feb. 1, 1983

[54] POOL CONSTRUCTION

[75] Inventor: Stanley R. Blakeway, Stafford Heights, Australia

[73] Assignee: Blakeway Marviroll Pools Pty. Ltd., Queensland, Australia

[21] Appl. No.: 121,786

[22] Filed: Feb. 15, 1980

[51] Int. Cl.[3] ..... E04H 3/16

[52] U.S. Cl. ..... 52/169.7; 4/506; 4/513

[58] Field of Search ..... 52/169.7, 300, 169.8, 52/169.9, 282, 630, 35; 4/506, 513

[56] References Cited

U.S. PATENT DOCUMENTS

| | | | |
|---|---|---|---|
| 2,143,034 | 1/1939 | Sakier | 52/35 |
| 3,114,244 | 12/1963 | Silver | 52/169.8 |
| 3,190,408 | 6/1965 | Petterson | 52/282 |
| 3,239,975 | 3/1966 | Stier | 52/300 |
| 3,588,924 | 6/1971 | Goettl | 52/169.7 |
| 3,641,595 | 2/1972 | Viessmann | 52/630 |
| 3,673,751 | 7/1972 | Boassy | 52/169.7 |
| 3,748,665 | 7/1973 | Viessmann | 52/630 |
| 3,930,346 | 1/1976 | Blakeway | 52/169.7 |

FOREIGN PATENT DOCUMENTS

| | | | |
|---|---|---|---|
| 4144 | 9/1979 | European Pat. Off. | 52/169.7 |
| 2416276 | 11/1974 | Fed. Rep. of Germany | 4/506 |

*Primary Examiner*—James L. Ridgill, Jr.

*Attorney, Agent, or Firm*—Schwartz, Jeffery, Schwaab, Mack, Blumenthal & Koch

[57] ABSTRACT

A pool, such as a swimming or ornamental pool, has a bottom of sheet material and a vertical wall section of pliable sheet material, both of which may be of vinyl-coated sheet steel. A flexible extruded junction member is grooved to receive the edge portion of the pool bottom, and also the bottom edge portion of the wall section, each of which is held in sealed manner in the junction member by a resiliently deformable sealing strip driven into the junction member adjacent to the bottom and/or walls section.

3 Claims, 5 Drawing Figures

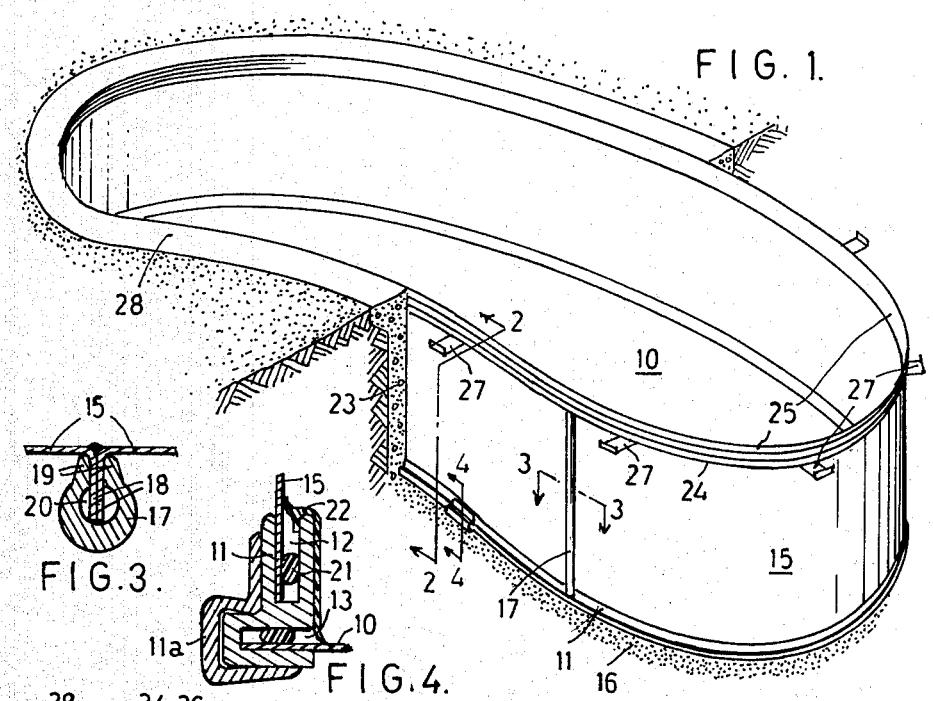
FIG. 1.
FIG. 3.
FIG. 4.
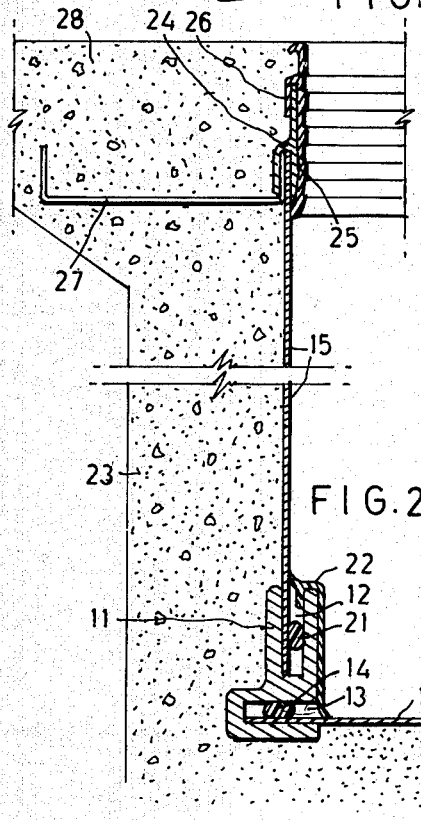
FIG. 2.
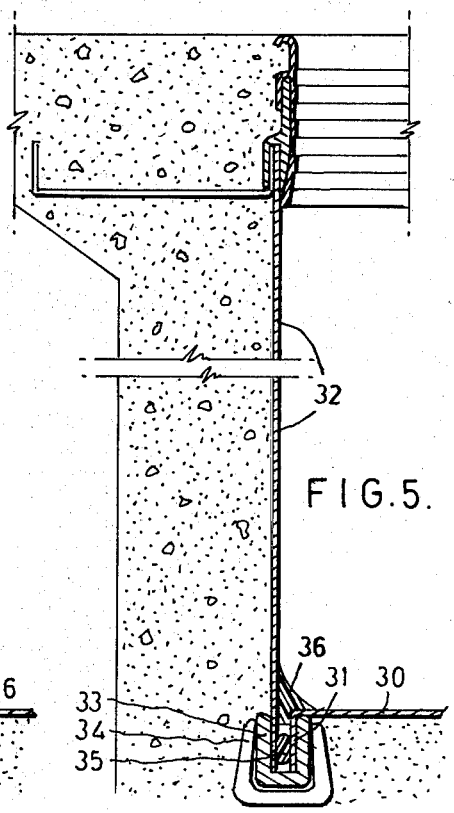
FIG. 5.

POOL CONSTRUCTION

BACKGROUND OF THE INVENTION

This invention relates to an improved pool construction.

There is a very wide range of materials and techniques available for the construction of pools, whether in-ground or above-ground swimming pools, ornamental pools, spa pools and so on. The construction of in-ground pools, in particular, is usually expensive and time consuming. It is known to construct an in-ground swimming pool consisting mainly of a pair of vertical sheet metal ends, and a sheet of flexible sheet metal, which can be rolled up for convenient transport and installation, forming the sides and bottom of the pool. A pool of this type, though simple and economical to manufacture and instal, has limitations in that it is essentially of substantially straight-sided trough-like form.

The present invention has been devised with the general object of providing a pool which is very simple and economical to make and instal, and which may have a very wide range of configurations in plan view. Another object achievable in preferred embodiments of the invention, is to provide such a pool which will not be likely to be damaged by external hydrostatic pressure when emptied.

BRIEF SUMMARY OF THE INVENTON

Broadly, the invention resides in a pool including a bottom section of sheet material; a wall section of pliable sheet material its end connected in sealed manner to form a complete loop, a junction member of flexible material, grooved longitudinally to recieve the periphery of the bottom section and also the bottom edge of the wall section; and means for securing and sealing the periphery of the bottom section, and the bottom edge of the wall section, in the junction member.

Other features of the invention will become apparent from the following description.

BRIEF DESCRIPTION OF THE DRAWINGS

In the drawings:

FIG. 1 is a partly broken-away perspective view of a pool according to the invention installed in-ground, FIG. 2 is a sectional view along line 2—2 in FIG. 1, FIG. 3 is a sectional view along line 3—3 in FIG. 1, FIG. 4 is a sectional view along line 4—4 in FIG. 1, and FIG. 5 is a view similar to FIG. 2, showing a modification of the invention.

DETAILED DESCRIPTION OF THE PREFERRED EMBODIMENTS

Referring initially to FIGS. 1, 2, 3 and 4 of the drawings, the pool illustrated includes a bottom section 10 made of vinyl-coated sheet steel, cut to the required shape, in plan view, of the pool. Around the bottom section there is secured and sealed a flexible junction member 11, which is a single length of extruded metal, preferably aluminium. In cross-section this extruded member is substantially L-shaped with a deep parallel-sided groove 12 formed from the top, and a second parallel-sided groove 13 formed from one side of its lower part, perpendicular to the groove 12. The edge portion of the bottom section 10 of the pool is engaged in the groove 13 and is held and sealed therein by a resiliently deformable sealing strip 14, normally round in cross-section but flattened when driven into the groove 13 between the upper face of the bottom section 10 and the upper face of the groove.

The pool includes a wall section 15 of sheet material such as vinyl-coated sheet steel, this material being pliable so that the wall section may be rolled up for convenient transport to the site.

The required outline of the excavation for the pool may be easily determined, by placing the bottom section 10 in the desired location and marking the bounds of the excavation a short distance outwardly of its periphery. When the excavation has been completed a bed of sand as indicated at 16 is laid in the excavation and compacted and levelled, and the bottom section 10 is placed on this, together with the junction member secured and sealed about its periphery. The abutting ends of the junction strip are beforhand secured together, either before delivery of the section to the site or, if preferred, at the site, by a clamping piece 11*a* and any suitable sealing adhesive.

The wall section 15 is un-rolled and installed in the excavation, its ends being first interconnected by means of a connector strip 17. As shown in FIG. 4, the extremities of the end portions of the wall section are bent outwardly through right angles to form flanges 18 which are placed adjacently and are driven into the connector strip 17 which is of extruded metal, preferably aluminium, the ajacent flanges 18 being forced between longitudinal projections or jaws 19 and into a central 20 through the strip 17. A suitable mastic is applied to the V-joint where the ends of the wall sections meet.

The bottom edge portion of the wall section 15 is engaged in the groove 12 of the junction member 11 and is secured and sealed therein by a resiliently deformable sealing strip 21, similar to the sealing strip 14 used to secure the bottom section 10 to the junction member 11. A finishing strip 22, of extruded resiliently deformable plastics material is applied to the junction member 11, being shaped for engagement with the upper inside part of the junction member, covering this member within the pool, and bearing against the wall section 15 above the junction member, and against the bottom section 10 inwardly of the junction member.

The pool is partly filled with water, and concrete, as indicated at 23, is poured into the excavation about the pool.

About the top edge of the wall section 15 there is engaged a top stiffening strip 24 of extruded metal, and over this there is fitted a wall trim 25 which is an extruded section of a plastics material, with an integral extension 26, hook-like in cross section engaging over the top edge of the stiffening strip. At intervals, channelled metal retaining pieces 27 extend outwardly from the upper part of the pool wall and are embedded in the concrete within the upper part of the excavation and forming a coping 28 about the pool. Each of these retaining pieces has one flange engaged with the stiffening strip 25, the other flange being embedded in the concrete.

In the embodiment of the invention shown in FIG. 5, the pool bottom 30 is formed with a peripheral downturned portion 31, which, together with the bottom edge portion of the pool wall section 32, is engaged in a modified junction member 33, which is of simple channelled form, of extruded aluminium or other suitable material, its ends being interconnected by a channel connector 34. The wall section 32 and its associated parts are as before described with reference to FIGS. 1, 2 and 3, but the bottom 30, having the downturned peripheral part 31, is preferably moulded of a material such as fibre-glass, or alternatively it may be of flexible vinyl or like material. Although, in FIG. 5, the illustrated part of the pool bottom 30 is shown as horizontal, a fibre-glass or like moulded bottom may, of course, be of concave form, and a bottom of a flexible vinyl or like materials may be seated on a concaved base foundation. Both the bottom edge portion of the wall section 32 and the downturned peripheral part 31 of the pool bottom are secured and sealed in the channel of the junction member 33 by a single resiliently deformable sealing strip 35 driven down between them, a pliable extruded finishing strip 36 having a part pressed down into the channel to cover the gap between the pool bottom and side.

In either form of the invention, the parts of the pool may be easily transported to the site and assembled. If the dimensions of a sheet metal pool bottom so require, it may be made in two or more parts connected together by means of a connector strip as shown at 17 in FIGS. 1 and 4.

An advantage of a pool according to the invention is that if the pool is, while empty or nearly empty, subjected to external hydrostatic pressure, which is liable to cause extensive damage to many conventional pools, then the pool bottom will be deformed upwardly, but before this deformation has become very pronounced it will result in the withdrawal of part of the pool bottom from the peripheral junction piece, the sealing strip 14 or 35 rolling within its channel to permit this, and as a result the external water will escape into the pool without causing any major damage. Subsequently, the part of the pool bottom which has been so withdrawn from the junction piece may be easily replaced and re-sealed.

I claim:

1. A swimming pool construction comprising:

(a) a horizontal bottom section of pliable vinyl-coated sheet steel material configured to the desired shape of the pool, (b) a substantially vertical wall section of pliable vinyl-coated sheet steel material, said vertical wall section being joined at the contiguous ends thereof and configured, in plan view, complementary to the configuration of said horizontal bottom section, (c) a flexible junction member comprising a single length of material curved to the configuration of said bottom section, and means for connecting the contiguous ends of said junction member, said junction member being generally L-shaped in cross-section, its lower part being formed with a horizontal parallel sided first groove open to the interior of the pool to receive the periphery of the bottom section, its upright part being formed with a vertical parallel sided second groove open at the top to receive the lower edge of the vertical wall section and perpendicular to and above said first groove, (d) means for retaining and sealing said wall sections in their mounted position in said junction member, said retaining and sealing means comprising a first resiliently deformable sealing strip under compression yet movable in said first groove adjacent to the inserted part of the bottom section and a second resiliently deformable sealing strip under compression in the second groove adjacent to the inserted part of the vertical wall section, whereby any upward deformation of said bottom section due to external hydrostatic pressure can be accommodated by withdrawal of at least part of said bottom section from said juncture member so as not to cause damage to said pool sections, and (e) a finishing strip of resiliently deformable plastic material shaped for engagement with the upper inside part of said juncture member and covering the same, said finishing strip bearing against said vertical wall section above said junction member and said strip bottom wall section inwardly of said junction member

2. A swimming pool construction comprising:

(a) a horizontal bottom section of pliable sheet material and configured to the desired shape of the pool, said bottom section being formed with a downwardly turned peripheral flange, (b) a substantially vertical wall section of pliable vinyl-coated sheet steel material, said vertical wall section being joined at the contiguous ends thereof and configured, in plan view, complementary to the configuration of said horizontal bottom section, (c) a flexible junction member comprising a single length of material curved to the configuration of said bottom section, and means for connecting the contiguous ends of said junction member, said junction member being generally U-shaped and opening at its top, the bottom of said vertical wall section and said downwardly turned peripheral flange extending downwardly into said junction member, (d) retaining and sealing means comprising a single resiliently deformable sealing strip under compression yet movable in said junction strip between the bottom of said vertical wall section and said downwardly turned peripheral flange, whereby any upward deformation of said bottom section due to external hydrostatic pressure can be accommodated by withdrawal of at least part of said bottom section from said juncture member so as not to cause damage to said pool sections, and (e) a finishing strip of resiliently deformable plastic material shaped for engagement with said junction member and covering the same, said finishing strip bearing against said vertical wall section above said junction member and said bottom wall section inwardly of said junction member.

3. The pool construction of claim 2 wherein said bottom wall section is of a material selected from the group consisting of fibre-glass or vinyl.

* * * * *